US005965334A

United States Patent [19]

Fyson et al.

[11] Patent Number: 5,965,334

[45] Date of Patent: Oct. 12, 1999

[54] PROCESS FOR THE DEVELOPMENT OF PHOTOGRAPHIC MATERIALS

[75] Inventors: John R. Fyson, Hackney; Helen M. Redfearn, Solihull, both of United Kingdom

[73] Assignee: Eastman Kodak Company, Rochester, N.Y.

[21] Appl. No.: 08/994,408

[22] Filed: Dec. 19, 1997

[30] Foreign Application Priority Data

Dec. 19, 1996 [GB] United Kingdom ..... 9626332

[51] Int. Cl.[6] ..... G03C 7/407

[52] U.S. Cl. ..... 430/373; 430/393; 430/414; 430/943

[58] Field of Search ..... 430/373, 393, 430/414, 943

[56] References Cited

U.S. PATENT DOCUMENTS

| | | | |
|---|---|---|---|
| 4,146,395 | 3/1979 | Bissonette . | |
| 5,021,326 | 6/1991 | Heinz et al. . | |
| 5,200,301 | 4/1993 | Wingender et al. | 430/373 |
| 5,354,647 | 10/1994 | Fyson | 430/393 |
| 5,358,830 | 10/1994 | Twist | 430/373 |
| 5,387,499 | 2/1995 | Earle et al. | 430/373 |
| 5,756,270 | 5/1998 | Fyson | 430/414 |

FOREIGN PATENT DOCUMENTS

| | | |
|---|---|---|
| 0 447 656 | 9/1991 | European Pat. Off. . |

*Primary Examiner*—Hoa Van Le
*Attorney, Agent, or Firm*—J. Lanny Tucker

[57] ABSTRACT

A process for the development of an imagewise exposed photographic recording material containing more than 200 mg/m$^2$ of silver comprises subjecting the photographic recording material to a development/amplification step using a developer/amplifier solution containing an oxidizing agent, and controlling the process temperature within the range of from 20 to 50° C. and the process time between 5 and 20 seconds. After the development/amplification step, the photographic material can be immediately subjected to a bleach-fix step, and staining is avoided.

7 Claims, No Drawings

PROCESS FOR THE DEVELOPMENT OF PHOTOGRAPHIC MATERIALS

FIELD OF THE INVENTION

This invention relates to a process for the development of imagewise exposed photographic recording materials, more particularly to a high-speed process in which the materials are developed in a redox developer/amplifier solution.

BACKGROUND OF THE INVENTION

Redox amplification processes have been described, for example in British Specifications Nos. 1,268,126; 1,399,481; 1,403,418; and 1,560,572. In such processes color materials are developed to produce a silver image(which may contain only small amounts of silver) and treated with a redox amplifying solution (or a combined developer/amplifier) to form a dye image.

The developer/amplifier solution contains a color developing agent and an oxidizing agent which will oxidize the color developing agent in the presence of the silver image which acts as a catalyst.

Oxidized color developer reacts with a color coupler to form the dye image. The amount of dye formed depends on the time of treatment or the availability of the color coupler and is less dependent on the amount of silver in the image than is the case in conventional color development processes.

Examples of suitable oxidizing agents include peroxy compounds including hydrogen peroxide and compounds which provide hydrogen peroxide, e.g., addition compounds of hydrogen peroxide such as perborates and addition compounds of hydrogen peroxide with urea. Other oxidizing agents include cobalt (III) complexes including cobalt hexammine complexes; and periodates. Mixtures of such compounds can also be used.

In color photography development (whether redox or conventional) it is necessary at an appropriate stage to remove the silver image which, if left behind would darken the dye image. Also it is necessary to remove unused silver halide because it darkens on exposure to light. To remove the silver, the practice has been to convert the silver to silver halide with a suitable oxidizing agent known in the art as a bleach and then remove the silver halide with a fixing agent.

Suitable oxidizing agents are potassium ferricyanide, or ferric iron complexed with ethylene diamine tetraacetic acid acting in the presence of potassium bromide. The two steps may be combined using a solution called a bleach-fix or blix.

In the case of a bleach-fix employed after a redox amplification, the solution only needs small amounts of iron (III) and thiosulfate because there is usually only a small amount of silver to remove.

U.S. Pat. No. 5,200,301 relates to a color photographic silver halide material which is particularly suitable for colored machine-readable identification systems. Machine-readable detection systems normally operate by I.R. absorption of the data applied and this patent is concerned with the problem of providing a color photographic material which produces a clear brilliant dye image and also shows adequate I.R. absorption in the data part, the I.R. zones being photographically produced. Although directed to a different problem from that with which the present invention is concerned, a process for the redox development of photographic materials containing greater than 200 mg/m$^2$ of silver is described in which the development stage is faster than conventional. A subsequent fixing step is disclosed but there is no bleaching step with the result that the silver is left in the developed photographic material.

Redox development/amplification is intended primarily for photographic materials containing low amounts of silver, especially for low silver photographic papers, i.e., containing less than 200 mg/m$^2$ of silver. The time of development using a redox system with low silver photographic paper is broadly similar to that for a conventional development process applied to conventional, i.e., higher silver-containing materials.

However, it is very desirable to be able to reduce the development time because this enables more photographic material to be processed with existing processing equipment or for the processing equipment to be made smaller.

SUMMARY OF THE INVENTION

According to the present invention, a process for the development of an imagewise exposed photographic recording material containing more than 200 mg/m$^2$ of silver, the process comprising subjecting the photographic recording material to a development/amplification step using a developer/amplifier solution containing an oxidizing agent while controlling the temperature within the range of from 20 to 50° C. and the process time between 5 and 20 seconds, preferably 7 to 15 seconds.

A solution to the noted problem has now been provided by a process in which a developer/amplifier solution containing an oxidizing agent is used for the development/amplification of a photographic recording material containing more than 200 mg/m$^2$ of silver and in which the time of the development/amplification is less than 20 seconds.

The development time is reduced. This means that the processor can be made smaller or, alternatively, the processor can be made more productive. Further the problem of staining which has been found to occur when a bleach-fix of conventional concentration follows the development/amplification has been avoided.

DETAILED DESCRIPTION OF THE INVENTION

A bleach-fix step preferably follows the development/amplification step and preferably employs a bleach-fix solution which contains iron (III) in concentration of from 0.02 to 0.5 moles per liter as the oxidant and a mixture of thiosulfate and sulfite (or metabisulfite) in amounts such that the concentration of thiosulfate is from 0.05 to 1 molar.

Preferably, the amounts of iron (III) complex and sulfite (or metabisulfite) added to make up the solution are from 0.015 to 0.3 moles of iron (III) complex and from 0.05 to 0.5 moles of sulfite.

Preferably, the bleach-fix step immediately follows the redox development/amplification step. By immediately we mean without any intervening treatment or step.

By process time we mean the time the photographic material is in the relevant solution, for example, the time of the redox development is the time measured in seconds that the photographic material is in the developer/amplifier solution.

The temperature of the bleach-fix solution is preferably from 24 to 50° C., more preferably from 30 to 45° C.

The oxidizing agent in the development/amplification is preferably hydrogen peroxide or a compound that generates hydrogen peroxide and the hydrogen peroxide is preferably present in amounts from 0.5 to 15 ml/l, more preferably 0.5 to 5 ml/l, and especially from 0.5 to 2.0 ml/l (as 30% w/w aqueous solution).

Preferably, the silver halide in the photographic material is substantially all silver chloride.

The color developing agent may be any of those known in the art, for example, the p-phenylene diamines, e.g.,:

4-amino N,N-diethylaniline hydrochloride;

4-amino-3-methyl-N,N-diethylaniline hydrochloride;

4-amino-3-methyl-N-ethyl-N-(β-(methanesulfonamido) ethyl)aniline sesquisulfate hydrate;

4-amino-3-methyl-N-ethyl-N-(β-hydroxyethyl)aniline sulfate;

4-amino-3-β-(methanesulfonamido)ethyl-N,N-diethyl aniline hydrochloride; and 4-amino-N-ethyl-N-(2-methoxyethyl)-m-toluidene di-p-toluene sulfonic acid.

The concentration range of the hydroxylamine component is from 0.5 to 4 and especially from 0.5 to 2 g/l (as hydroxylamine sulfate).

The pH is preferably in the range 10.5 to 12 preferably 11 to 11.7.

The composition is preferably free of any compound that forms a dye on reaction with oxidized color developer.

Color developer solutions for silver chloride color papers do not contain hydroxylamine sulfate because it can act as a black-and-white developing agent and this severely inhibits dye yield. Instead, diethylhydroxylamine is used because it does not inhibit dye yield.

Conveniently, the redox developer/amplifier solution used in the present invention comprises a color developing agent, hydrogen peroxide or a compound which provides hydrogen peroxide, and hydroxylamine or a salt thereof, and wherein the concentration ranges are:

hydrogen peroxide from 0.5 to 15 ml/l (as 30% w/w solution), hydroxylamine or a salt thereof from 0.25 to 8 g/l (as hydroxylamine sulfate), and wherein the pH is in the range from 10.5 to 12.5.

The composition is preferably free of any compound that forms a dye on reaction with oxidized color developer.

For stable formulations the relative proportions of hydrogen peroxide (as ml/l of a 30% w/w solution) and hydroxylamine compound (as g/l hydroxylamine sulfate) may need to be balanced to give the required result. Because the process time is relatively short, this is optional for the redox developer/amplification solutions used in the present invention.

The photographic material may be first subjected to a development step with a developer solution containing no peroxide or other oxidizing agent before the redox amplification.

As previously stated the color photographic material will contain more than 200 mg/m$^2$ of silver and preferably more than 300 mg/m$^2$ of silver. That is to say, they contain conventional amounts of silver rather than the low amounts of silver that are normally used in redox development.

A particular application of redox amplification is in the processing of silver chloride color paper, for example, paper comprising at least 85 mole % silver chloride.

The material may comprise the emulsions, sensitizers, couplers, supports, layers, additives, etc. described in *Research Disclosure*, Dec. 1978, Item 17643, published by Kenneth Mason Publications Ltd., Dudley Annex, 12a North Street, Emsworth, Hants P010 7DQ, U.K.

In a preferred embodiment, the photographic material to be processed comprises a resin-coated paper support and the emulsion layers comprise more than 80%, preferably more than 90% silver chloride, and are more preferably composed of substantially pure silver chloride.

The photographic materials can be single color materials or multicolor materials. Multicolor materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolor photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

As stated above, the process of the invention is particularly suitable for use in a tank of relatively small volume, and in a preferred embodiment the ratio of the tank volume to maximum area of material accommodatable therein (i.e., maximum path length times width of material) is less than 11 dm$^3$/m$^2$, preferably less than 3 dm$^3$/m$^2$.

The process may be carried out in what is known in the art as a minilab, for example, the tank volume may be below 5 liters and sometimes below 3.0 liters, conveniently in the range 1.5 to 2.5 liters, and may be about 1 liter.

The material to be processed is conveniently passed through the tank and preferably the developer solution is recirculated through the tank at a rate of 0.1 to 10 tank volumes per minute. The preferred recirculation rate is from 0.5 to 8 especially from 1 to 5 and particularly from 2 to 4 tank volumes per minute.

The recirculation with or without replenishment may be carried out continuously or intermittently. In one method of working both can be carried out continuously while processing is in progress but not at all or intermittently when the tank is idle.

Replenishment may be carried out by introducing the required amount of replenisher into the recirculation system either inside or outside the processing tank.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution of less then 11 mm, preferably less than 5 mm and especially about 2 mm.

The shape of the tank is not critical but it may conveniently be in the shape of a shallow tray or, preferably U-shaped.

It is preferred that the dimensions of the tank be chosen so that the width of the tank is the same as, or only just wider than, the width of the material being processed.

The total volume of the processing solution within the processing channel and recirculation system is relatively smaller as compared with prior art processes. In particular, the total amount of processing solution in the entire processing system for a particular module is such that the total volume in the processing channel is at least 40% of the total volume of the processing solution in the entire system. Preferably the volume of the processing channel is at least about 50% of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6<F/A<23$$

where F is the flow rate of the solution through the nozzle in liters/minute, and A is the cross-sectional area of the nozzle provided in square centimeters.

Providing a nozzle in accordance with the foregoing relationship assures appropriate discharge of the processing solution against the photosensitive material.

Such low-volume thin-tank systems are described in more detail in the following patent specifications: U.S. Pat. No. 5,294,956; U.S. Pat. No. 5,179,404; U.S. Pat. No. 5,270,762; EP-A-559,025; EP-A-559,026; EP-A-559,027; WO 92/10790; WO 92/17819; WO 93/04404; WO 92/17370; WO 91/19226; WO 91/12567; WO 9207302; WO 93/00612; WO 92/07301; and U.S. Pat. No. 5,436,118.

The invention is illustrated by the following Examples.

All processing was carried out in the dark with 500 ml measuring cylinders as tanks, placed in a tempered water bath. The exposed strips of paper were held in the appropriate tank by means of a clip for the required amount of time. Agitation of the strip was by manual lifting of the strip by 5 cm and dropping again every 2 seconds turning the strip by 180° at the same time.

All the strips were exposed to through 0.15 log exposure wedge for 1/10 of a second, through a filter pack that has been determined to give neutral images with KODAK EKTACOLOR™ Edge 2 paper processed through KODAK™ Process RA-4.

For all experiments sensitometric parameters are given. These include Dmin (stain), Dmax, contrast and relative speed measured at 0.8 density units above Dmin for each color layer.

Comparison Example

A strip of exposed KODAK EKTACOLOR™ Edge 2 paper containing 600 to 700 mg/m$^2$ of silver was processed in KODAK™ Process RA-4 using chemicals made up to the tank concentrations as instructed.

The processing sequence was as follows:

| | | |
|---|---|---|
| Develop | 45 seconds | 35° C. |
| Bleach-fix | 45 seconds | 35° C. |
| Wash in running water | 90 seconds | 35° C. |

The resultant sensitometry is shown in Table 1.

TABLE 1

| Layer | Dmin | Dmax | Contrast | Relative Speed |
|---|---|---|---|---|
| red | 0.094 | 2.59 | 3.72 | 129.1 |
| green | 0.103 | 2.62 | 3.42 | 124.2 |
| blue | 0.096 | 2.39 | 2.82 | 124.3 |

EXAMPLE 1

(Comparison and Invention)

An experiment was carried out with the following developer and bleach-fix using the paper as described in the Comparative Example.

| Developer | |
|---|---|
| sequestrant | 0.6 g |
| DTPA | 0.81 g |
| $K_2HPO_4.3H_2O$ | 40.0 g |
| KBr | 1.5 mg |
| KCl | 0.45 g |
| Catechol disulfonate | 0.3 g |
| Hydroxylamine sulfate | 1.2 g |
| KOH (solid) | 10.0 g |
| color developer | 5.5 g |
| TWEEN 80 (warmed) | 0.3 g |
| dodecyclamine (10% in glacial acetic acid) (dissolved in TWEEN) | 1.0 ml |
| water to 1 liter | |
| pH adjusted to 11.5 with KOH solid | |
| Sequestrant used in all the examples was a aqueous solution of 1-hydroxyethylidene-1,1-diphosphonic acid. | 60% w/w |
| DTPA is diethylene triamine pentaacetic acid. | |

Color developing agent used in all the Examples was N-(2-(4-amino-N-m-toluidino)ethyl)-methanesulfonamide sesquisulfate hydrate.

| bleach-fix | |
|---|---|
| $NH_4FeEDTA$ (1.56 molar solution) | 200 ml |
| ammonium thiosulfate | 60 g |
| sodium metabisulfite | 35 g |
| water to 1 liter | |
| pH adjusted to 5.5 | |
| EDTA is ethylenediaminetetraacetic acid. | |

The process cycle was as follows:

| | | |
|---|---|---|
| Develop | 10 seconds | 35° C. |
| Bleach-fix | 12 seconds | 35° C. |
| Wash in running water | 12 seconds | 35° C. |
| Dry at room temperature | | |

The experiment was also run with 0.8 ml/l of hydrogen peroxide (30% w/w aqueous solution) added to the developer to demonstrate the ability of peroxide to accelerate the dye formation process and give adequate dye (matching the control) in a short time. The results are shown in Table 2.

TABLE 2

| Process | Layer | Dmin | Dmax | Contrast | Relative Speed |
|---|---|---|---|---|---|
| no | red | 0.085 | 2.18 | 2.67 | 113.5 |
| peroxide | green | 0.103 | 2.45 | 3.26 | 111.3 |
| | blue | 0.099 | 1.78 | 2.14 | 100.0 |
| with | red | 0.093 | 2.56 | 3.61 | 130.2 |
| peroxide | green | 0.105 | 2.70 | 3.36 | 124.6 |
| | blue | 0.100 | 2.42 | 2.92 | 120.3 |

The process without the peroxide was included for comparison.

The results show that the peroxide gives extra photographic speed, Dmax and contrast with only a slight stain penalty (as evidenced by the Dmin value), and allows a 10 second development step to match that of conventional paper with a 45 second development time (see Table 1 and Comparative Example). The whole wet part of the process can be achieved with agitation as described above in 34 seconds instead of 180 seconds (which is typical of the RA-4 process) and also avoid changes in sensitometry.

EXAMPLE 2

Effect of Developer Time on Stain Caused by Bleach-fix

The paper was as described above. The problem with an experiment to test this is that if silver halide is present in the paper, this will develop in the non-exposed areas and cause staining which will increase with the development time. It is necessary to separate out the staining in the bleach-fix which might be attributed to iron catalyzed development in the presence of peroxide. In order to do this, the silver was removed from the paper before processing by treating with a fixer of the following formula:

| | |
|---|---|
| ammonium thiosulfate | 100 g |
| sodium sulfite | 10 g |
| water to 1 liter | |

The paper was then washed to remove residual fixer. The total process sequence was as follows:

| | | |
|---|---|---|
| Fix | 60 seconds | 35° C. |
| Wash in running water | 60 seconds | 35° C. |
| Develop | variable (see Table 3) | 35° C. |
| Bleach-fix | 12 seconds | 35° C. |
| Wash in running water | 12 seconds | 35° C. |
| Dry at room temperature | | |

The process was then carried out as before and the stains were recorded. The results are shown in Table 3.

TABLE 3

| Development Time (Seconds) | Red Dmin | Green Dmin | Blue Dmin |
|---|---|---|---|
| 0 | 0.093 | 0.106 | 0.102 |
| 10 | 0.094 | 0.106 | 0.102 |
| 15 | 0.095 | 0.108 | 0.104 |
| 20 | 0.103 | 0.128 | 0.115 |
| 30 | 0.103 | 0.134 | 0.115 |
| 45 | 0.103 | 0.135 | 0.116 |
| 60 | 0.118 | 0.149 | 0.131 |

These results show that, under the conditions of this example, when a bleach-fix step immediately follows a development/amplification step using peroxide, provided the time of the development/amplification step is 15 seconds or less, the stain as indicated by the Dmin value is kept to a low level.

The invention has been described in detail with particular reference to certain preferred embodiments thereof, but it will be understood that variations and modifications can be effected within the spirit and scope of the invention.

We claim:

1. A process for the development of an imagewise exposed photographic recording material containing more than 300 mg/m$^2$ of silver, said process comprising subjecting said photographic recording material to a development/amplification step using a developer/amplifier solution containing an oxidizing agent while controlling the temperature within the range of from 20 to 50° C. and the process time between 5 and 15 seconds wherein after said development/amplification step, the photographic material is immediately subjected to a bleach-fix step.

2. The process of claim 1 wherein said process temperature is controlled at from 27 to 45° C. and said process time is from 7 to 15 seconds.

3. The process of 1 wherein said bleach-fix step employs a bleach-fix solution containing iron (III) in concentration of from 0.02 to 0.5 moles per liter as the oxidant, and a mixture of thiosulfate and sulfite in amounts such that the concentration of thiosulfate is from 0.05 to 1 molar.

4. The process of claim 1 wherein the combined process time for said development/amplification step and said bleach-fix step is from 25 to 40 seconds.

5. The process of claim 1 wherein at least 90% of the silver in the photographic recording material is present as silver chloride.

6. The process of claim 1 wherein said oxidizing agent is a peroxide or a compound that provides peroxide, and said peroxide is present in an amount from 0.5 to 15 ml/l (as 30% w/w aqueous solution).

7. The process of claim 1 carried out in a low-volume thin-tank.

* * * * *